US008186083B2

(12) United States Patent
Chua et al.

(10) Patent No.: US 8,186,083 B2
(45) Date of Patent: May 29, 2012

(54) METHOD AND APPARATUS FOR MARKETING AN OBJECT

(75) Inventors: Johnson Chua, Singapore (SG); Yam Fei Lian, Singapore (SG); Boon Keat Eddy Toh, Singapore (SG); Jeng Khim Tan, Singapore (SG); Kar Choon Ng, Singapore (SG)

(73) Assignee: Creative Technology Ltd, Singapore (SG)

( * ) Notice: Subject to any disclaimer, the term of this patent is extended or adjusted under 35 U.S.C. 154(b) by 161 days.

(21) Appl. No.: 12/544,077

(22) Filed: Aug. 19, 2009

(65) Prior Publication Data

US 2011/0041368 A1 Feb. 24, 2011

(51) Int. Cl.
*G09F 23/00* (2006.01)

(52) U.S. Cl. ..... 40/463; 345/87; 345/58

(58) Field of Classification Search ..... 40/594, 40/595, 638; 206/459.1, 457, 534, 335, 776, 206/777, 769, 770, 775, 45.2; 249/58, 61, 249/65, 112, 113, 149, 151
See application file for complete search history.

(56) References Cited

U.S. PATENT DOCUMENTS

| | | | | | |
|---|---|---|---|---|---|
| 4,384,763 | A * | 5/1983 | Russo | 349/82 |
| 5,142,384 | A * | 8/1992 | Wood et al. | 359/3 |
| 5,460,325 | A * | 10/1995 | Surman | 232/17 |
| 5,919,074 | A * | 7/1999 | Honda | 446/268 |
| 6,070,724 | A * | 6/2000 | McCool | 206/352 |
| 6,084,526 | A * | 7/2000 | Blotky et al. | 340/691.6 |
| 6,106,121 | A * | 8/2000 | Buckley et al. | 359/839 |
| 6,118,420 | A * | 9/2000 | Yamamoto et al. | 345/87 |
| 6,749,437 | B2 * | 6/2004 | Chan | 434/393 |
| 7,379,243 | B2 * | 5/2008 | Horsten et al. | 359/320 |
| 7,748,149 | B1 * | 7/2010 | Reavis | 40/566 |

* cited by examiner

*Primary Examiner* — Joanne Silbermann
*Assistant Examiner* — Shin Kim
(74) *Attorney, Agent, or Firm* — Creative Technology Ltd

(57) ABSTRACT

There is provided a method and an apparatus for marketing an object. The apparatus includes a display with a first mode and a second mode; and a housing for containing the object adjacent to the display. The display may preferably be coupled to a controller circuit for activating transition of the display between the first mode and the second mode, with the object being viewable through the display in the second mode. The method includes carrying out activities to create an association between the apparatus and the object; using the apparatus for containment of items; and causing an increase in awareness in the object through use of the apparatus.

15 Claims, 6 Drawing Sheets

METHOD AND APPARATUS FOR MARKETING AN OBJECT

FIELD OF THE INVENTION

The invention relates to the field of product marketing. In particular, the invention relates to a method and apparatus for marketing an object.

BACKGROUND OF THE INVENTION

Consumers today have shorter attention spans than previous generations of consumers given the myriad of information sources such as, for example, television, radio, internet, and the like fighting for their attention. As such, it has become increasingly challenging to distinguish a product from another product and to capture the attention of the distracted consumer. It is generally acknowledged that the commercial success of a product is partially dependent on product marketing. If consumers are not aware of a product's existence and/or virtues, it is unlikely that consumers would covert the product and subsequently consider purchasing the product.

Traditional ways of product marketing involve the use of placement location, colors, shapes, unusual package designs, illumination techniques and so forth. However, for products that are not visible from within the packaging, consumers typically have to request for the sales personnel to open the product and should there be any delay/inconvenience, the consumers may walk off without viewing and understanding the product. Consumers who do not view and understand products will typically not covert the product per se even in the present era of readily-available online product catalogs. As such, transparent materials may be used for product packaging to enable the consumers to view the products in a convenient manner. However, while this may be convenient for the consumer, the disadvantage is that the product may be perceived to be a low-end/low-quality product and this may adversely affect the perception of the product which may cause consumers to deliberately shy away from purchasing the product.

Furthermore, product packaging is typically designed for storage and protection of the product during transportation, and when in a retail outlet's inventory. Such packaging is typically disposable. There have been instances when certain forms of packagings were used to commemorate events, occasions, special edition products and so forth. However, such packagings do not include an aspect which generates interest from the use of the packagings. In addition, disposable packagings are also typically harmful to the environment as the packagings are typically non-biodegradable.

In view of the preceding paragraphs, it is evident that there are issues pertaining to product packaging which need to be addressed.

SUMMARY OF THE INVENTION

In a first aspect, there is provided an apparatus for marketing an object. The apparatus includes a display with a first mode and a second mode; and a housing for containing the object adjacent to the display. The display may preferably be coupled to a controller circuit for activating transition of the display between the first mode and the second mode, with the object being viewable through the display in the second mode. The display may be hinged to the housing. The display may be opaque in the first mode, with the opaque display being either a dark surface or a reflective surface.

It is preferable that the transition of the display between the first mode and the second mode includes effects such as, for example, a vertical scrolling effect, a horizontal scrolling effect, appearance of a graphic object and the like. Activating the transition of the display between the first mode and the second mode may comprise either applying a force on the display or triggering an actuator which is electrically coupled to the controller circuit. Alternatively, activating the transition of the display between the first mode and the second mode may include providing an audio output such as, for example, a song, a spoken phrase, an aural notation and so forth. In addition, activating the transition of the display between the first mode and the second mode may also include providing illumination to the object adjacent to the display.

It is preferable that the controller circuit is incorporated in a part of the apparatus such as, for example, a frame of the display, the housing, a supporting structure and the like.

It is preferable that displacing the display may provide an audio output such as, for example, a song, a spoken phrase, an aural notation and the like.

The apparatus may further include supporting structures located within the housing, the supporting structures being for a role such as, for example, holding the object, partitioning an area within the housing, absorbing impact forces exerted onto the apparatus, adding structural strength to the housing and so forth.

In a second aspect, there is provided a method of marketing an object using the earlier described apparatus. The method includes carrying out activities to create an association between the apparatus and the object; using the apparatus for containment of items; and causing an increase in awareness in the object through use of the apparatus. Preferably, the activities may be carried out via either online selling channels or brick-and-mortar selling channels.

BRIEF DESCRIPTION OF THE DRAWINGS

In order that the present invention may be fully understood and readily put into practical effect, there shall now be described by way of non-limitative example only preferred embodiments of the present invention, the description being with reference to the accompanying illustrative drawings.

DETAILED DESCRIPTION OF THE EMBODIMENTS

Figure 1:
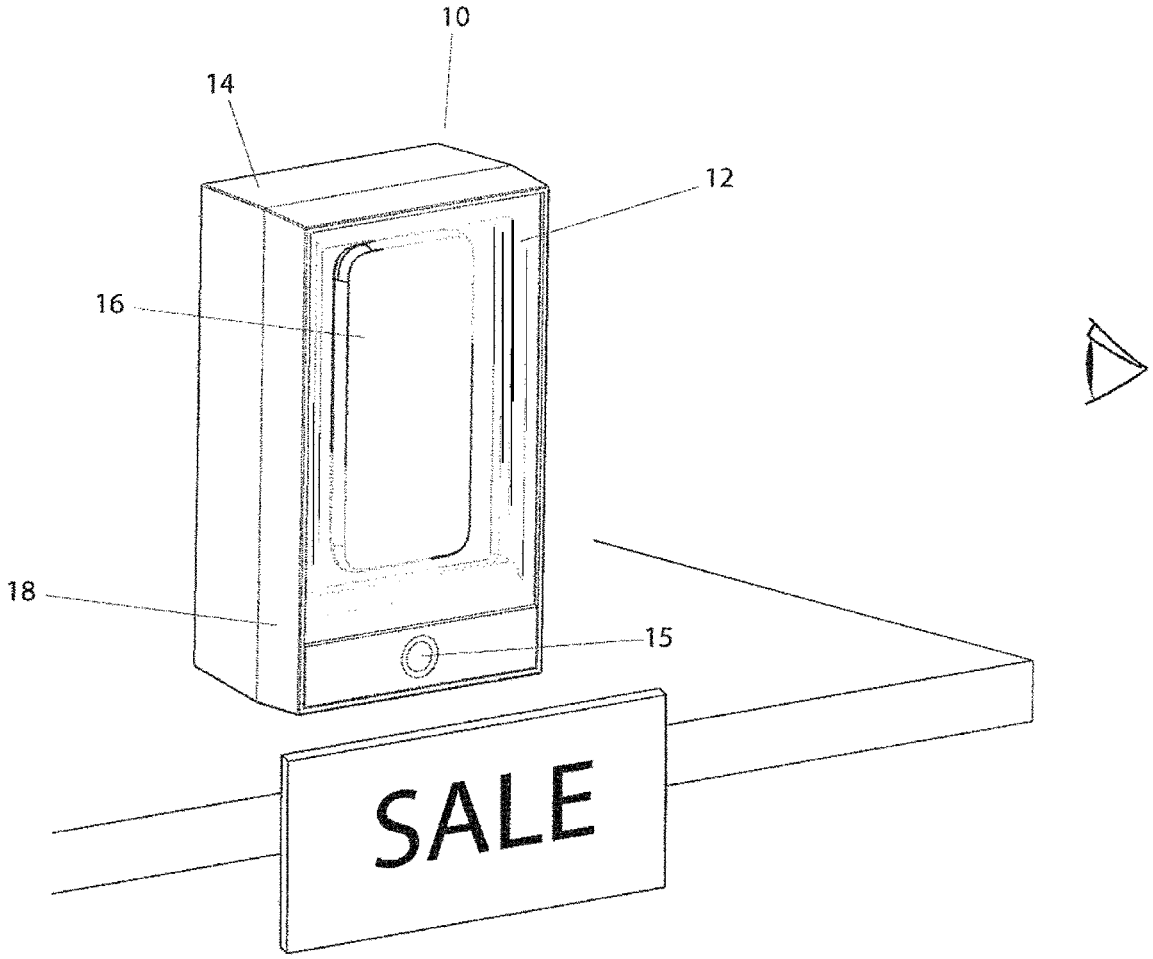
FIG. 1 illustrates a perspective view of an apparatus during use while located on a platform according to a first aspect of the invention.
Figure 2:
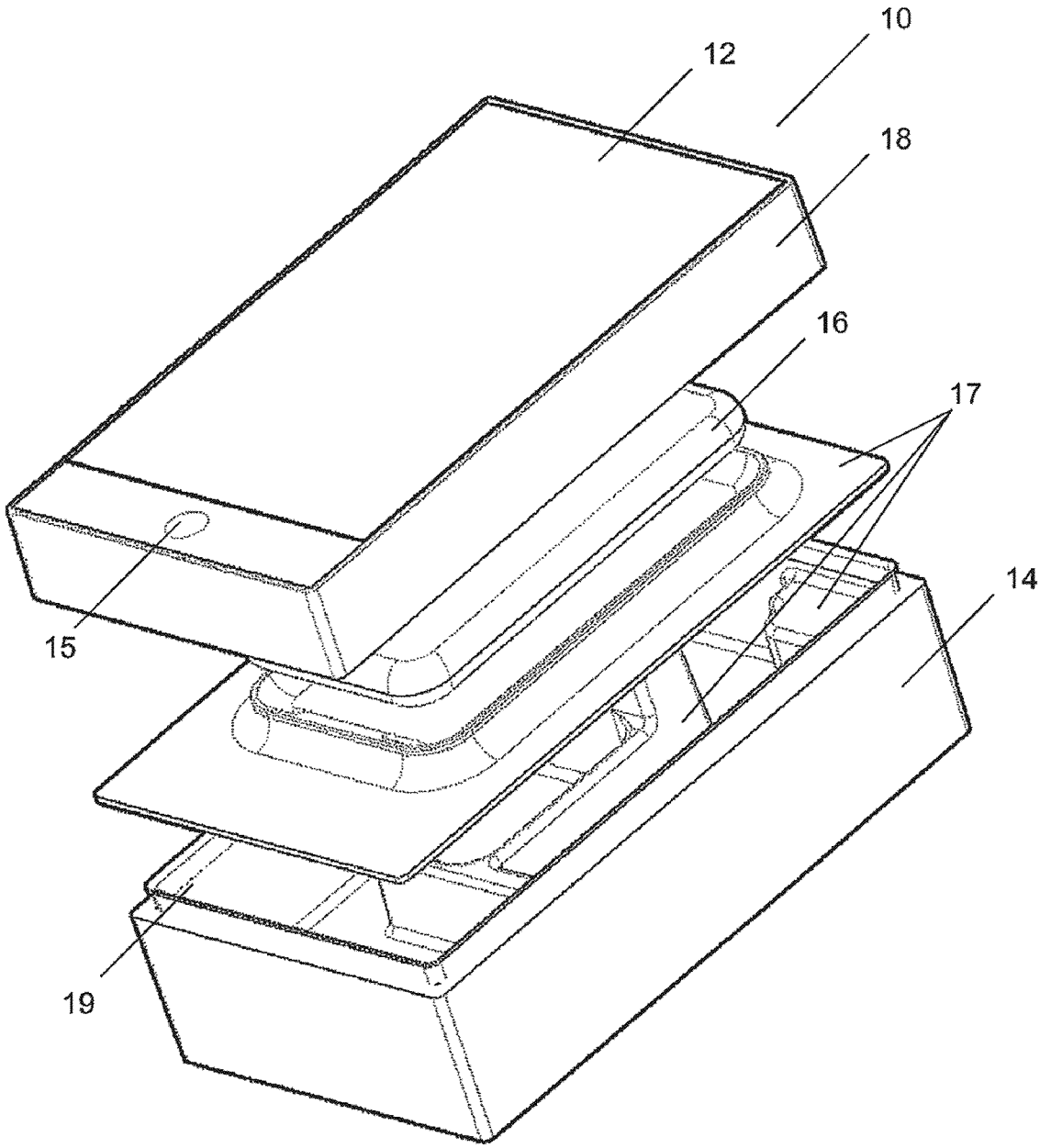
FIG. 2 illustrates an exploded view of the apparatus.

FIG. 1 illustrates a perspective view of the use of an apparatus 10 for marketing an object 16 in accordance with a first aspect of the invention. FIG. 2 shows an exploded view of the apparatus 10. It should be noted that the physical appearance of the apparatus 10 as shown in FIGS. 1 and 2 is merely representative and not restrictive in any manner. The apparatus 10 includes a display 12 and a housing 14 for containing the object 16 at a position adjacent to or behind the display 12. The apparatus 10 may also include supporting structures 17 which may be used for functions such as, for example, holding the object 16, partitioning an area 19 within the housing 14, absorbing impact forces exerted onto the apparatus 10, adding structural strength to the housing 14 to withstand stacking forces and so forth. The display 12 may be either mounted onto a frame 18 that either rests on or encloses (mounts on) the housing 14. The frame 18 may be either removable from the housing 14 or hinged to the housing 14. When the frame 18 is hinged to the housing 14, the frame 18 may be flipped open in a manner depending on which edge the frame 18 is hinged at. In this instance, the object 16 is a handheld electronic device.

It should be appreciated that the apparatus 10 may be used in a manner where a plurality of the apparatus 10 may be stackable with each display 12 of the apparatus 10 being visible while the plurality of the apparatus 10 are stacked. Stacking the plurality of the apparatus 10 should not lead to damage to each object 16 contained within each apparatus 10, as construction of the housing 14 and the supporting structures 17 of the apparatus 10 enable each apparatus 10 to sustain loads resulting from the stacking of the plurality of the apparatus 10.

Referring to FIG. 1, in a first mode, the object 16 is hidden from view. The display 12 may include a reflective layer such that the object 16 is hidden from view in the first mode. The reflective layer may be either adhered to the display 12 and/or incorporated into the display 12. The display 12 may function as a reflective surface for reflecting an image such that a consumer sees an image of oneself when looking at the display 12.

Consumers are typically accustomed to either looking at products that are left in plain view or looking at product depictions on product packagings per se. The apparatus 10 offers an alternative manner for a consumer to view the object 16 contained within the apparatus 10. This alternative manner to view the object is likely to either arouse or increase the consumer's interest in viewing the object 16. Therefore, the apparatus 10 advantageously piques the interest of the consumer as the consumer is unable to garner information on at least an appearance of the object 16 during the first mode. Further interest from the consumer may also be aroused given a contrast of an understated appearance of apparatus 10 compared with gaudy and colourful packagings of other products that are displayed around the apparatus 10 in a retail outlet. While the object 16 is hidden from view in the first mode, the consumer is likely to hold or touch the display 12 in an attempt to obtain a view of the object 16. In addition, the alternative manner which causes the object 16 to be visible to the consumer may also garner additional attention due to a novelty aspect which leads to the object 16 being viewable. The object 16 is depicted to be semi-visible in FIG. 1 in order to graphically illustrate how the object 16 is hidden from view in the first mode and clearly visible in a second mode. The novelty aspect and the encompassing the second mode will be described in greater detail in a subsequent portion of the description.

Figure 3A:
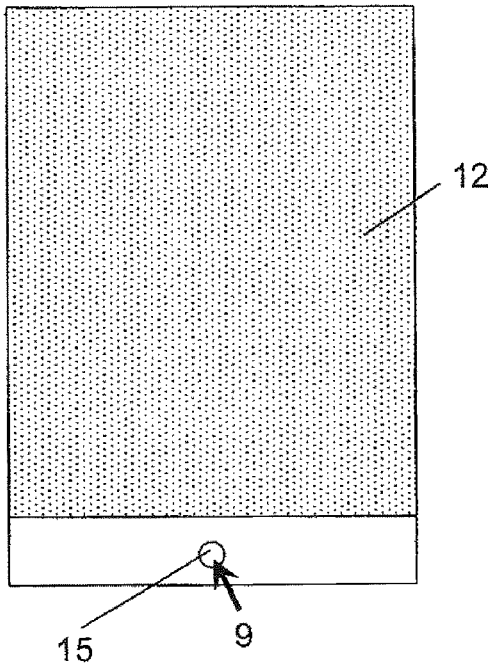
FIG. 3 illustrates a representation of the apparatus during use.
Figure 3B:
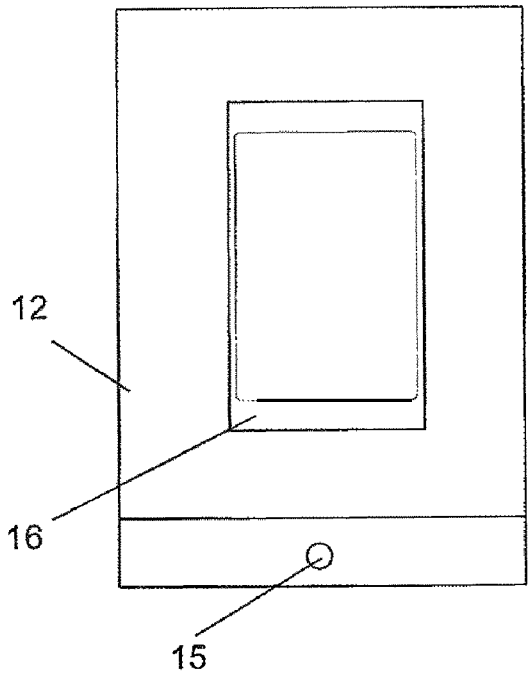

In FIG. 3(*a*), a force 9 is shown being applied to an actuator 15 located adjacent to the display 12 when the display 12 is in the first mode. The location of the actuator 15 is merely illustrative and not limiting in any way. FIG. 3(*b*) shows the display 12 in the second mode after the force 9 has been applied to the actuator 15. When the display 12 is in the second mode, the object 16 located adjacent to the display 12 becomes visible. It should be appreciated that the force 9 may also be applied directly to the display 12 rather than the actuator 15 in an instance when the display 12 is a touch-sensitive panel. The actuator 15 is electrically coupled to the display 12 to invoke a change in a state of the display 12 from the first mode to the second mode using a controller circuit (11 in FIG. 6) coupled to the display 12. The actuator 15 may be, for example, a touch sensor, a tactile switch, or any device which is usable to trigger transmission of an electrical signal. The controller circuit 11 may be incorporated into the housing 14, the frame 18 or the supporting structures 17. The controller circuit 11 may likely be incorporated in the housing 14 when the display 12 is hinged to the housing 14 for stability of the apparatus 10. Being able to incorporate the controller circuit 11 into the supporting structures 17 may enable a more flexible configuration in relation to size of the object 16 which is able to be placed within the apparatus 10. Having the controller circuit 11 in the supporting structures 17 may also enable control of LED arrays (62 in FIG. 6) included with the apparatus 10. The display 12 may be a LCD module.

Figure 6:
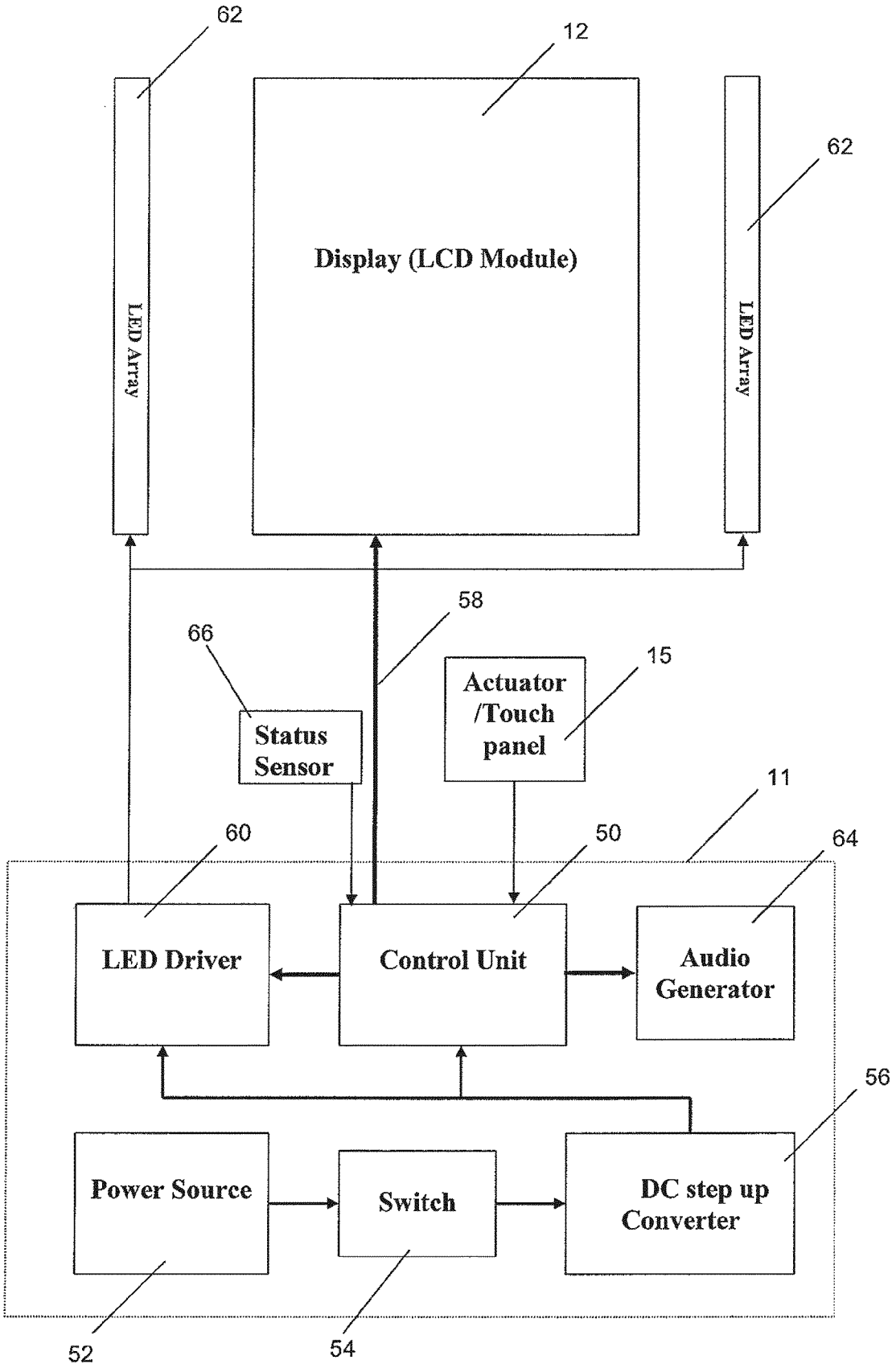
FIG. 6 illustrates a schematic diagram of components of the display of the apparatus.

Referring to FIG. 6, the controller circuit 11 includes a control unit 50 to control processes handled by the controller circuit 11. The control unit 50 processes inputs from either the touch-sensitive panel or the actuator 15 to determine the mode of the display 12. In the instance when the display 12 is a LCD module, the mode of the display 12 is determined when the control unit 50 transmits a LCD control signal 58 to the display 12. The LCD module of the display 12 may include a multi-layered arrangement of films and/or substrates as per conventional LCD modules. However, the LCD module of the display 12 may be configured in a manner where the LCD module appears opaque (either a dark or reflective surface) when the LCD control signal 58 is not transmitted to the display 12. The LCD module of the display 12 may be opaque in the first mode. Consequently, the LCD module appears transparent when the LCD control signal 58 is transmitted to the display 12. The LCD module of the display 12 may be transparent in a second mode.

The controller circuit 11 may include a power source 52 for powering the controller circuit 11. The power source 52 may include, for example, dry cells solar cells, capacitors, and the like. The controller circuit 11 may also have a switch 54 to enable either opening or closing of the controller circuit 11. The switch 54 may aid in prolonging longevity of the power source 52 as opening the controller circuit 11 prevents continual draining of the power source 52. The controller circuit 11 may also include a DC step-up converter 56 to enable provision of an adequate voltage to ensure that the control unit 50 and, in certain instances, an LED driver 60 are adequately powered. For example, the power source 52 may be rated to provide 1.5V, while the control unit 50 may be rated at 3V. As such, the DC step-up converter 56 enables the 1.5V power source 52 to power the 3V-rated control unit 50.

The controller circuit 11 may also include the LED driver 60 which controls at least one LED array 62 used for illuminating the object 16 in the apparatus 10.

Each LED array 62 should include a plurality of LEDs to provide adequate illumination to enable visibility of the object 16 within the housing 14 of the apparatus 10. The at least one LED array 62 may be incorporated within either the frame 18 or the housing 14. The control unit 50 may also instruct the LED driver 60 to power the at least one LED array 62 when transmitting the LCD control signal 58 to the display 12. It should be appreciated that the control unit 50 may instruct the LED driver 60 either simultaneously or after a delay. For example, the delay may be a time required for the LCD module in the display 12 to transition from the first mode to the second mode. This enables the display 12 to appear to be transparent with a corresponding illumination effect on the object 16 within the housing 14 caused by the at least one LED array 62. The at least one LED array 62 may be lit to a maximum brightness either gradually or at a single instance. Furthermore, the at least one LED array 62 may be controlled to be lit up in, for example, a blinking manner, a running manner, a pre-determined sequential manner and so forth.

The controller circuit 11 may also include an audio generator 64. The control unit 50 may also instruct the audio generator 64 to generate an audio output when transmitting the LCD control signal 58 to the display 12. It should be appreciated that the control unit 50 may instruct the audio generator 64 either simultaneously or after a delay. For example, the delay may be a time required for the LCD module in the display 12 to transition from the first mode to the second mode. This enables the display 12 to appear to be transparent with the object 16 being visible within the housing 14 before the audio output is generated. The audio output may be, for example, a song, a spoken phrase, an aural notation and so forth. The at least one LED array 62 may also be controlled to be lit up in a synchronized manner with the generated audio output from the audio generator 64.

In addition, the controller circuit 11 may also include an apparatus status sensor 66 which detects whether the display 12 is completely covering the area 19 within the housing 14. When the display 12 is completely covering the area 19 within the housing 14, the apparatus status sensor 66 transmits a "closed" status to the control unit 50. When the display 12 is displaced and does not completely cover the area 19 within the housing 14, the apparatus status sensor 66 transmits an "open" status to the control unit 50. When the control unit 50 receives the "open" status from the apparatus status sensor 66, the control unit 50 may instruct the audio generator 64 to generate an audio output such as, for example, a song, a spoken phrase, an aural notation and so forth. This may ensure that the audio output is generated from the audio generator 64 when a user displaces the display 12 to access the area 19 within the housing 14.

Figure 4:
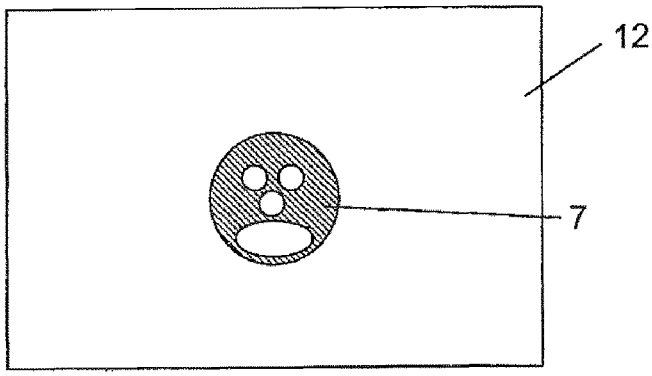
FIG. 4 illustrates a first sample visual effect on a display of the apparatus.
Figure 5A:
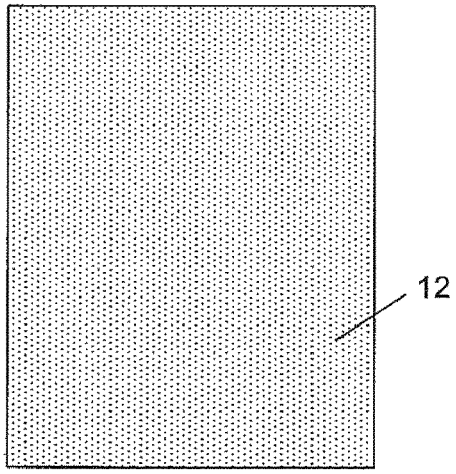
FIG. 5 illustrates a second sample visual effect on the display of the apparatus.
Figure 5B:
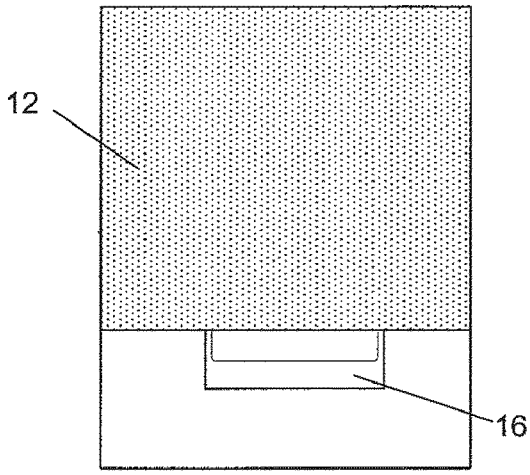
Figure 5C:
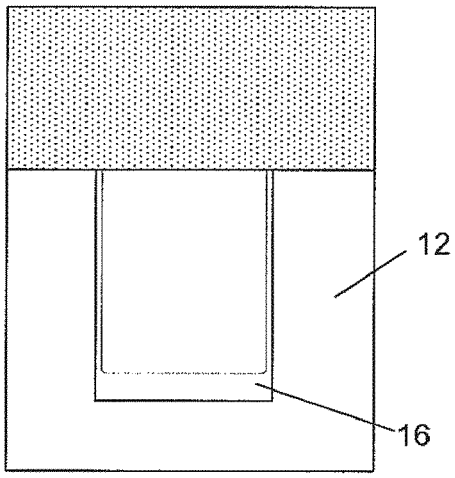
Figure 5D:
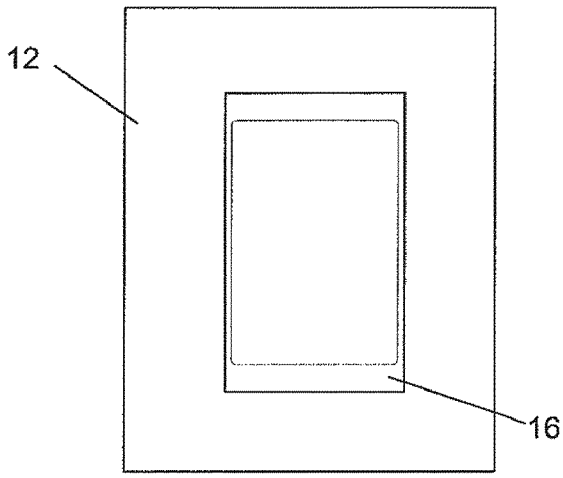

Referring to FIG. 5, when the display 12 is activated to transition from the first mode to the second mode, the LCD module of the display 12 may be controlled by the control unit 50 to generate a display effect during the transition from the first mode to the second mode. While the display effect shown in sequence from FIG. 5(*a*) to FIG. 5(*b*) to FIG. 5(*c*) to FIG. 5(*d*) is of a vertical scrolling effect, the display effect may also include, for example, a horizontal scrolling effect, an appearance of a graphic object (as shown in FIG. 4) and so forth. It should be appreciated that the graphic object as shown in FIG. 4 may be generated by having an imprint of components 7 making up the graphic object made to the display 12, where the imprint of components 7 remains visible when the LCD module of the display 12 is in the second mode.

The display effect 103 may be dependent on both the LCD module of the display 12 and how the control unit 50 controls the LCD module of the display 12. The LCD module may be specified to appear in a particular manner when controlled by the control unit 50 either when transitioning to the second mode or when in the second mode.

Referring to FIG. 3(*a*), when the display 12 is in the first mode, the object 16 which is placed within the housing 14 adjacent to (behind) the display 12 is not visible through the display 12. Referring to FIG. 3(*b*), when the display 12 is in the second mode, the object 16 which is placed within the housing 14 adjacent to (behind) the display 12 is viewable through the display 12. It is not mandatory for the at least one LED array 62 to be lit for the object 16 to be visible. The difference between the first mode and the second mode and a net effect is thus clearly denoted in FIGS. 3(*a*) and 3(*b*).

An advantage of the apparatus 10 is that the apparatus 10 attracts the attention of the consumer when the display 12 is in the first mode (consumer would be intrigued by what is in the apparatus 10) and allows the object 16 (product) to "communicate" with the consumer once the display 12 is in the second mode. When the display 12 is in the second mode, when the consumer makes contact with either the display 12 or the actuator 15, the display 12 may transition from the second mode to the first mode. Alternatively, the display 12 may transition from the second mode to the first mode after a predetermined period of time has elapsed from when the display 12 transitioned from the first mode to the second mode. This may be because the display 12 consumes less power in the first mode compared to the second mode.

In a preferred embodiment, the apparatus 10 may be reusable for the placement of other items. The supporting structures 17 shown in FIG. 2 may be disposable. When the apparatus 10 is re-used in such a manner, the use of the apparatus 10 may enhance an awareness of the object 16 as there may be an association of the apparatus 10 with the object 16. In this regard, when the apparatus 10 is seen to be utilized for the placement of other items, a message relating to an existence of the object 16 is transmitted, where this is especially so in instances where a question of "where did the apparatus 10 come from" is answered.

Figure 7:
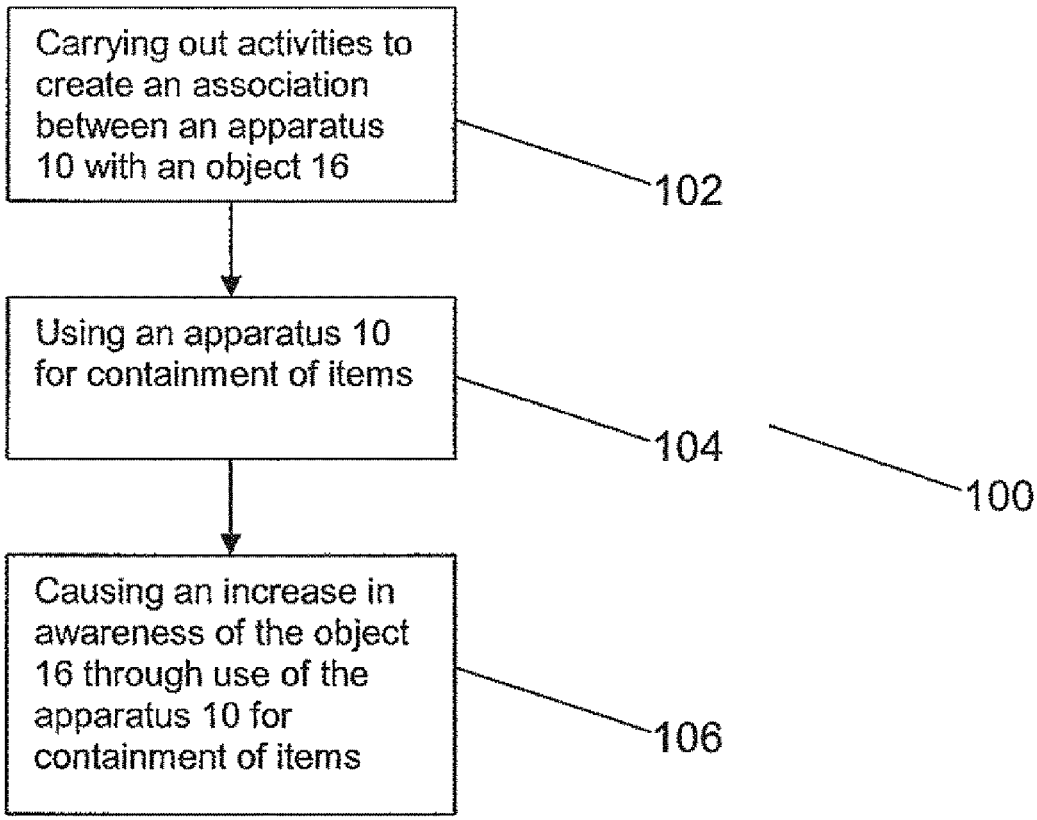
FIG. 7 illustrates a process flow of a method of the present invention.

Referring to FIG. 7, there is shown a process flow for a method 100 for marketing an object in accordance with a second aspect of the present invention. The method 100 may include use of the apparatus 10 as described earlier. The method 100 may include carrying out activities to create an association between the apparatus 10 and the object 16 encased within the apparatus 10 (102). The object 16 may be a handheld electronic device which is available for sale when packaged in the apparatus 10. The activities being carried out may be marketing-type activities which cause consumers to form the association between the apparatus 10 and the object 16. The marketing-type activities may be via either online selling channels or brick-and-mortar selling channels.

Subsequently, the method 100 includes using the apparatus 10 for containment of items (104). By using the apparatus 10 for the containment of items, the method 100 also causes an increase in awareness of the object 16 by consumers who come across the apparatus 10 being used for the containment of items (106).

Whilst there has been described in the foregoing description preferred embodiments of the present invention, it will be understood by those skilled in the technology concerned that many variations or modifications in details of design or construction may be made without departing from the present invention.

The invention claimed is:

1. An apparatus for marketing an object, the apparatus including:

a display through which the object is viewable, the display being associable with one of a first mode and a second mode;

a housing and supporting structures within the housing for at least one of holding the object and partitioning an area within the housing, the object being adjacent to the display; and an apparatus status sensor for detecting whether the display is displaced relative to the area within the housing, wherein the display is coupled to a controller circuit for activating transition of the display between the first mode and the second mode, wherein when in the first mode, the display is configurable to impede viewing of the object, and wherein when in the second mode, the display is configurable to allow viewing of the object therethrough.

2. The apparatus of claim 1, wherein the transition of the display between the first mode and the second mode includes effects selected from the group consisting of a vertical scrolling effect, a horizontal scrolling effect, and appearance of a graphic object.

3. The apparatus of claim 1, wherein the display is hinged to the housing.

4. The apparatus of claim 1, wherein the controller circuit is incorporated in a part of the apparatus selected from the group consisting of a frame of the display, the housing and a supporting structure.

5. The apparatus of claim 1, wherein activating the transition of the display between the first mode and the second mode comprises either applying a force on the display or triggering an actuator which is electrically coupled to the controller circuit.

6. The apparatus of claim 5, wherein activating the transition of the display between the first mode and the second mode includes providing an audio output selected from the group consisting of a song, a spoken phrase, and an aural notation.

7. The apparatus of claim 5, wherein activating the transition of the display between the first mode and the second mode includes providing illumination to the object adjacent to the display.

8. The apparatus of claim 1, wherein displacing the display provides an audio output selected from the group consisting of a song, a spoken phrase, and an aural notation.

9. The apparatus of claim 1, the supporting structures being further for a role selected from the group consisting of absorbing impact forces exerted onto the apparatus and adding structural strength to the housing.

10. The apparatus of claim 1, wherein the display is opaque in the first mode.

11. The apparatus of claim 1, wherein the opaque display is either a dark surface or a reflective surface.

12. The apparatus as in claim 1, further comprising an audio generator which is configurable to generate an audio output when the apparatus status sensor determines that the display is displaced relative to the area within the housing.

13. The apparatus as in claim 12, wherein the apparatus status sensor determines that the display is displaced relative to the area within the housing when the display does not completely cover the area within the housing.

14. A method of marketing an object using an apparatus, including:

carrying out activities to create an association between the apparatus and the object;

using the apparatus for containment of items, the apparatus comprising:

a display which is associable with one of a first mode and a second mode;

a housing and supporting structures within the housing for at least one of holding the object and partitioning an area within the housing, the object being adjacent to the display; and an apparatus status sensor for detecting whether the display is displaced relative to the area within the housing; and causing an increase in awareness in the object through use of the apparatus, wherein when in the first mode, viewing of the object through the display is impeded, and wherein when in the second mode, viewing of the object through the display is allowed.

15. The method of claim 14, wherein the activities are carried out via either online selling channels or brick-and-mortar selling channels.

* * * * *